US006772799B1

(12) United States Patent
Pruitt

(10) Patent No.: US 6,772,799 B1
(45) Date of Patent: Aug. 10, 2004

(54) BOTTLE NECK RING AND METHOD OF ITS USE IN THE PROCESSING OF DRINKS

(75) Inventor: Dan Pruitt, San Diego, CA (US)

(73) Assignee: Coca-Cola Enterprises Inc., Atlanta, GA (US)

( * ) Notice: Subject to any disclaimer, the term of this patent is extended or adjusted under 35 U.S.C. 154(b) by 0 days.

(21) Appl. No.: 10/394,636

(22) Filed: Mar. 21, 2003

(51) Int. Cl.[7] ..... B21F 27/00

(52) U.S. Cl. ..... 141/1; 141/369; 141/372; 141/378

(58) Field of Search ..... 141/1, 369, 370, 141/372, 378, 94; 53/490, 317; 215/46

(56) References Cited

U.S. PATENT DOCUMENTS 4,164,964 A * 8/1979 Daniels ..... 141/372

4,911,212 A * 3/1990 Burton ..... 141/378

OTHER PUBLICATIONS

US 2003/0155320 A1; Peronek et al.; Aug. 21, 2003.*

* cited by examiner

*Primary Examiner*—Gregory L. Huson
*Assistant Examiner*—Khoa Huynh
(74) *Attorney, Agent, or Firm*—Stephen J. Stark; Miller & Martin PLLC

(57) ABSTRACT

The method of manufacturing and bottle having a neck ring with a first face having a distinguishing characteristic wherein the first face may be distinguished, and thus oriented, thereby orienting the soft drink bottle during the filling, labeling and/or packaging process. The first face is preferably planar so that it may cooperate with a guide so that the bottle may be rotated about a longitudinal axis extending through the bottle for either maintaining the orientation of the bottle or for changing the bottle orientation during various steps of the manufacturing and filling processes.

16 Claims, 2 Drawing Sheets

BOTTLE NECK RING AND METHOD OF ITS USE IN THE PROCESSING OF DRINKS

FIELD OF THE INVENTION

The invention relates to methods and devices utilized to make bottles, fill them with liquid, and package the filled bottles, and more particularly to methods and apparatus for assisting in orienting bottles for packaging, filling and/or processing.

BACKGROUND OF THE INVENTION

Blow molded plastic bottles have largely replaced the heavier glass bottles previously used for soft drinks, and the like. In commonly utilized two-liter and twenty-ounce bottles formed of plastic, the weight of the bottle itself is negligible as compared to the weight of glass bottles of similar capacity. The first plastic bottles were generally two piece bottles comprising a pressure vessel portion and base which permitted the bottle to stand upright on shelves, and the like. The pressure vessel portion was typically of a tough, flexible plastic (e.g. polyester) which became resiliently rigid for gripping due to the internal pressure created by the carbon dioxide gas in the soft drink liquid contained therein. The bottom was hemispherical and the separate base was required in order for the bottle be able to stand by itself. The base was typically of a plastic such as polyethylene and is attached over the bottom of the pressure vessel portion with adhesive.

One alternative to a two-piece construction is to create a bottle having a so-called "champagne" base which resists the internal pressure. Inversion is a problem in such designs. In an attempt to avoid that problem, numerous bottle configurations have been proposed incorporating, for example, integral pressure-resistant ribs into the bottom of the bottle. More recently, bottle designs utilizing a petaloid base have been proposed. In all polyester (usually PET) bottles, weight is a very important consideration. Based on a conservative estimate of 5 billion bottles produced per year and a PET price of $(US) 1.54 per Kg($(US) 0.70 per pound), a 1–2 gram decrease in the PET content of a bottle would save approximately $(US) 7–14 million per year.

While many forming techniques and designs have been directed to the bases to reduce the amount of plastic in the base, few techniques and designs have been directed to the necks of the bottles. In most bottle designs, the top portion of the bottle has a neck finish having a set of male threads on an outer surface which mate with internal female threads in a cap. Below the neck finish on the bottle is a neck ring. This neck ring constitutes a relatively large portion of the plastic material utilized in the formation of the bottle.

Additionally, as most plastic bottles are substantially round, or at least curved, about their perimeter, there is a tendency for the bottles to spin during the travel through the various operations at a bottling plant such as filling, capping and/or packaging. There are some problems which can result from spinning bottles during the filling/capping, and packaging processes.

Furthermore, since most bottles are substantially round or ribbed about their perimeter, along any given cross section of the bottle, there is no easy way to orient these bottles for packing. For instance, if all of the labels are intended to face a certain direction for packaging as a six-pack, there is no easy way to orient the bottles, especially when spinning is occurring through the packaging equipment and process.

Accordingly, a need exists for an improved neck ring and methods of its use and implementation during the filling, capping and packaging processes.

SUMMARY OF THE INVENTION

It is an object of the present invention to provide a construction method and design for the neck ring of a one piece plastic bottle for containing carbonated beverages providing a smaller perimeter and/or using less material than prior art designs.

It is a further object of the present invention to provide a method for utilizing the neck ring of a bottle to orient the bottle along the filling, capping and/or packaging process.

It is another object of the present invention to provide a method for reducing, if not eliminating spinning during the filling, capping and/or packaging process.

According to the invention there is provided a method and process of making a bottle having a neck with a positioner, preferably circumscribed within a circumference of a traditional neck ring, said positioner comprised of at least one distinguishable section so that the bottle may be oriented using a guide and/or sensor.

In the preferred embodiment, the positioner is comprised of a plurality of segments at least partially circumscribed within the circumference of a traditional neck ring with at least one segment having a different characteristic, such as a longer length, so that the neck ring may be sensed and oriented during the filling, capping and/or packaging steps. Specifically, by being able to orient the bottle during the application of labels and packaging, the orientation of the bottles in a packaged form may be pre-selected. During capping, the neck ring may be utilized to keep the bottle from spinning. By circumscribing the segments within the circumference of a traditional neck ring, the area defined by the circumference and segment represents plastic which is not utilized in the new design, and a cost savings to the bottle manufacturer. Finally, by having planar faces on the neck, the bottle may be retained and/or guided in areas where spinning has occurred with traditional substantially round neck rings and bottles.

The bottles are preferably constructed utilizing a blow molding process for producing a self-standing one-piece polyester container for carbonated beverages. The bottles are traditionally defined by a longitudinal axis and comprise a sidewall portion which is integral with and terminates at a lower portion in a closed base of a petaloid form defining at least three feet disposed about the longitudinal axis whereby the container is self standing. A neck ring is located at a top portion with the threads located above the neck ring. The improved neck ring comprises the positioner described above.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 1:
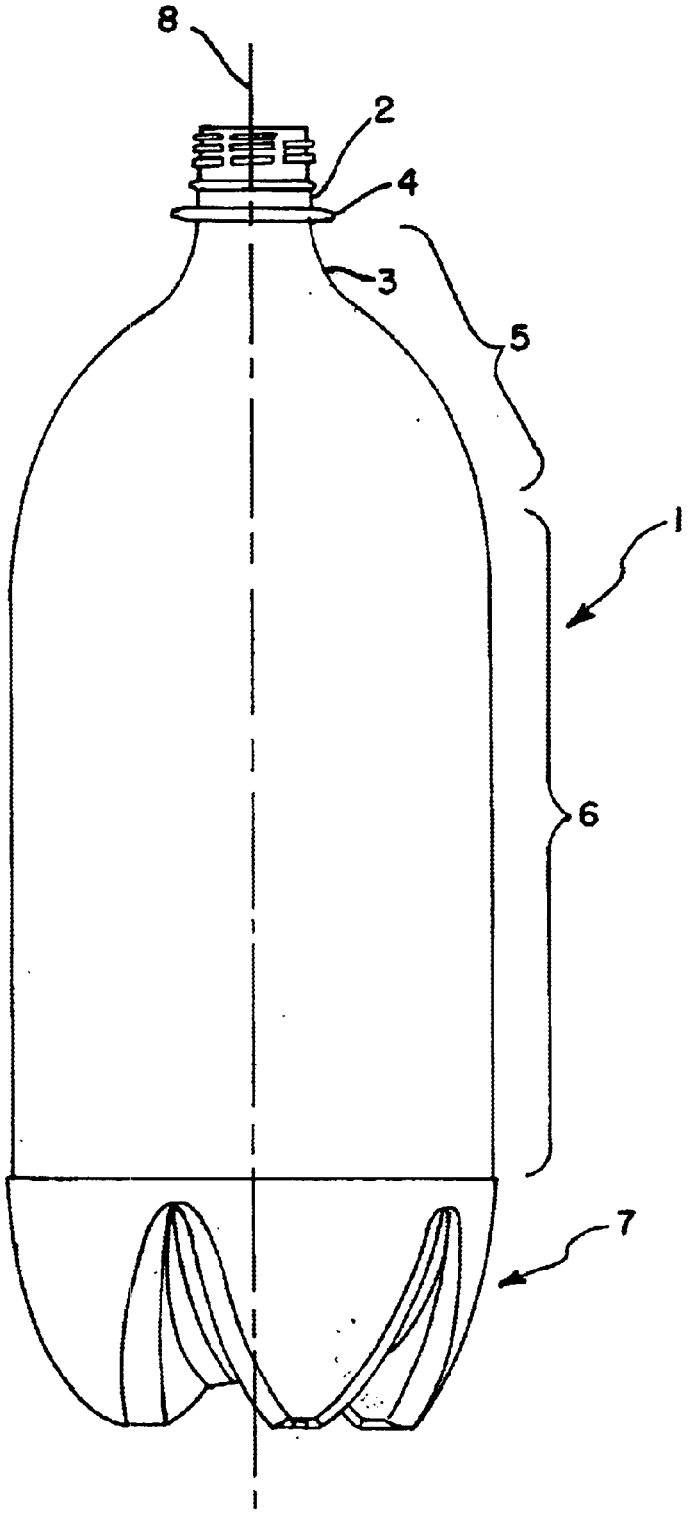
FIG. 1 PRIOR ART
FIG. 1 is a prior art bottle with a neck ring.

Referring first to FIG. 1, a prior art one piece self-standing bi-axially oriented PET two-liter bottle 1, of circular horizontal cross-section, comprises a neck finish 2 connected to a neck transition portion 3 by way of a neck support ring 4. Other size bottles, such as twenty-ounce bottles are similarly formed. The neck transition portion 3 connects by way of an upper portion 5 of the bottle 1 to a substantially cylindrical sidewall portion 6 which terminates at its lower end in a closed base 7, the underlying shape of which is hemispherical. The bottle 1 defines a longitudinal axis 8.

Figure 2:
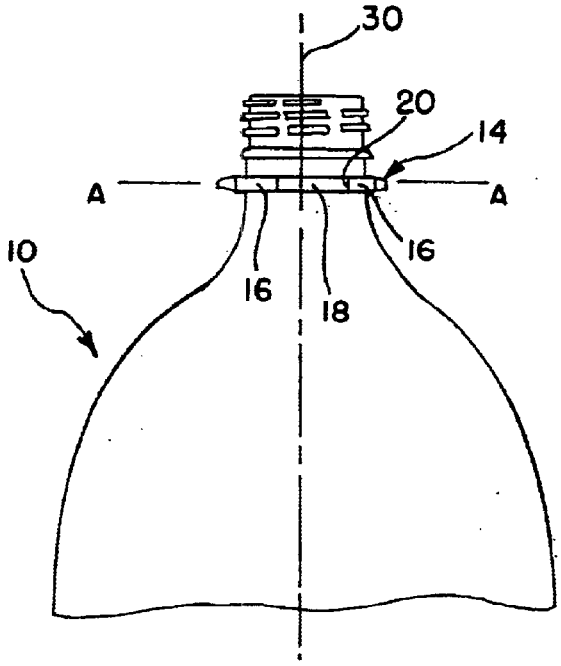
FIG. 2 is a side view of the neck ring of the preferred embodiment of the present invention.

FIG. 2 shows a bottle 10 substantially identical to the prior art bottle 1 except for having the neck ring 14 according to the preferred embodiment of the present invention.

Figure 3:
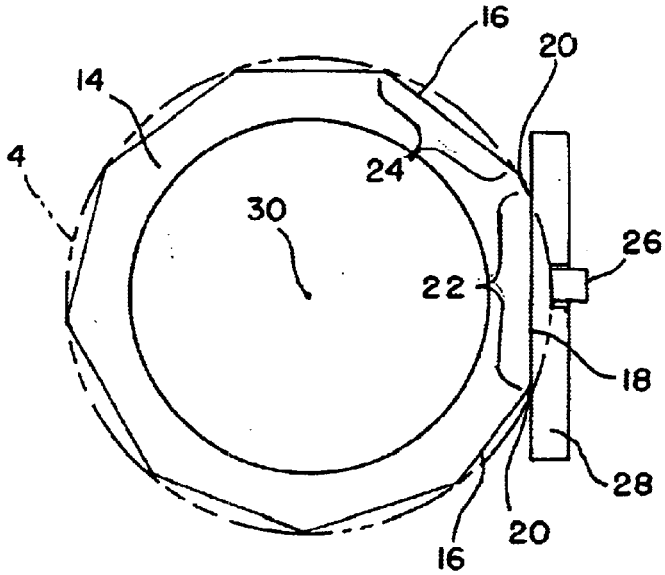
FIG. 3 is across sectional view taken along the line A—A of FIG. 2 as shown against a guide with a sensor.

As shown in FIGS. 2 and 3, the neck ring 14 preferably has a smaller volume than the prior art neck ring 4 shown in FIG. 1 which is also shown in phantom in FIG. 3. In fact, the neck ring 14 is shown circumscribed within the circumference and perimeter of the prior art neck ring 4 which has a circular cross section.

Neck ring 14 is preferably comprised of a plurality of planar faces 16,18, such as five to nine, that meet at corners 20. Comers 20 need not be sharply angled, but could have gradual curved edges. At least one of the faces 18 differs in a characteristic from the remaining faces 16. It is further preferred that at least two faces 16,18 are parallel to one another. As shown in FIG. 3, face 18 is longer than other faces 16. Accordingly, the length 22 is greater than length 24. This allows a sensor 26 to detect the distinguishing face 18 so that the bottle 10 may be oriented during the filling and/or packaging processes. The presence of parallel faces 16,18 has been found helpful to allow opposing guides to direct the bottle 10 through various stages of the manufacturing process.

Although a longer length 22 is the characteristic utilized in the preferred embodiment, in other embodiments it may be that the distinguishing face 18 is the only substantially planar face on the circumference about the perimeter of the neck ring 14 (thereby being the distinguishing characteristic) or it could be a shorter length 22 or other attribute. As shown in FIG. 2, the faces 16,18 are preferably planar and meet at corners 20. Of course, in another embodiment the faces 16 may not necessarily be planar. Furthermore, the faces 16 may not meet at corners with the other faces 16. Additionally, although other faces 16 are illustrated as having the same length as FIG. 3, it may be that faces 16 do not have the same length. As long as distinguishing face 18 has a different characteristic on the remaining faces 16, it is not believed to make a difference if the other faces 16 differ from one another or not.

The distinguishing characteristic of the preferred embodiment of the neck ring 14 is the length 22 of face 18. In other embodiments the height, or other characteristic such as texture, color or otherwise could be the distinctive characteristic as long as it can be sensed by a sensor 26.

Another advantage of the preferred embodiment invention as shown in FIG. 3 is the presence of at least one planar face 16,18. By having at least a portion of the neck ring 14 linear along the length 22 as shown in FIG. 3 then a guide 28 may be utilized adjacent to the neck ring during the filling, capping and/or packaging steps so that the bottle 10 resists twisting during the manufacturing processes. Two guides 28 could be utilized especially if at least some of faces 16,18 are parallel to one another which would be particularly helpful during capping. In the prior art the cylindrical nature of the neck ring did not often hold or grip as shown in FIG. 3 since the corners 20 would resist twisting relative to guide 28 during the manufacturing process. Guide 28 can also be utilized to rotate the bottle 10 about its longitudinal axis or prevent rotation about the longitudinal axis for packaging, affixing labels with the bottle 10 facing in a predetermined direction or other step of the manufacturing process; or otherwise assist in positioning at least one of the bottles 10.

FIG. 3 also shows the difference between the preferred neck ring 14 and the prior art neck ring 4. The shaded sections represent plastic material which will not be necessary in the preferred embodiment. Accordingly, this reduction in plastic equates to a cost savings especially in light of the huge number of bottles produced annually.

A bottle 10 preferably blow molded to form a self-standing, one-piece polyester container defining a longitudinal axis 30 and comprising a sidewall portion terminating at a first end at a close base portion, said sidewall portion terminating at a neck ring 14 at a second end sidewall portions, said first second ends opposing one another, said neck ring 14 having a first face with a distinguishing characteristic. The sensor 26 can be utilized to assist in locating the distinguishing face of the neck ring such as face 28. The bottles may then be rotated about their longitudinal axes 30 so that face 28 may be oriented in a predetermined manner. A label may applied to a bottle along the sidewall portion or otherwise. Additionally, the guide 28 could be utilized to contact a planar face 28 of the neck ring 14 through at least one step of the manufacturing process, such as to either prevent unwanted rotation about the longitudinal axis 30, or to orient bottles in accordance with a predetermined packaging arrangement.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of orienting plastic bottles comprising:

a) providing self standing bottles of one-piece polyester construction defining a longitudinal axis and comprising a sidewell portion terminating at a first end at a closed base portion, said sidewall portion terminating at an opposing second end with a neck finish connected to the sidewall portion by way of a neck ring, the neck ring further comprising a first planar face and at least one second face;

b) providing a sensor located relative to at least one of the guide and the neck ring, said sensor configured to detect the first face of the neck ring and c) while moving the bottles, utilizing at least one guide to contact the first planar face of the neck ring to assist in positioning at least one of the bottles, and the sensor assists in distinguishing the first from the second face to assist in positioning the bottles in accordance with a predetermined scheme.

2. The method of claim 1 wherein the first face has a length longer than the at least one second face and the sensor measures the length of the first and at least one second face to assist in positioning the at least one of the bottles.

3. The method of claim 1 wherein the guide is adapted to rotate the at least one of the bottles about its longitudinal axis while orienting the at least one of the bottles.

4. The method of claim 1 wherein during the step of positioning the bottles, the bottles are packaged with the first faces of the bottles oriented in accordance with a predetermined configuration.

5. The method of claim 1 wherein during the step of moving the bottles, the guide prevents undesired rotation of the bottles about their longitudinal axes.

6. A method of providing filled plastic bottles comprising the steps of:

a) blow molding a self standing one-piece polyester container defining a longitudinal axis and comprising a sidewall portion terminating at a first end at a closed base portion, said sidewall portion connected to a neck finish at a neck ring at a second end of the sidewall portion, said first and second ends opposing one another, said neck ring having a first face with a distinguishing characteristic and at least one second face;

b) utilizing a sensor to assist in locating the distinguishing, characteristic of the first face of the neck ring relative to the at least one second face; and c) rotating the bottle about the longitudinal axis so that the distinguishing characteristic of the first face is oriented in a predetermined manner.

7. The method of claim 6 further comprising the step of applying a label to the bottle, and wherein the step of orienting the bottles is performed prior to having the label applied to the bottle.

8. The method of claim 6 further comprising the step of placing a guide in contact with a planar portion of the neck ring to prevent unintended rotation about the longitudinal axis.

9. The method of claim 6 wherein during the step of blow molding the bottle, the first face is formed having a planar surface.

10. The method of claim 9 wherein during the step of blow molding, forming said at least one second face in the neck ring with said first face having a greater length than a length of the at least one second face.

11. The method of claim 9 wherein during the step of blow molding, forming a plurality of faces along with the first face with a total number of faces ranging from about five to about nine.

12. The method of claim 9 wherein the first face is formed circumscribed within a circle about a perimeter of the neck ring.

13. A method of manufacture of claim 1 wherein the first face terminates at opposing corners along a length of the first face.

14. The method of manufacture of claim 1 wherein the sensor is utilized to measure the length of the first face.

15. The method of manufacture of claim 1 wherein the first face is one of a plurality of faces formed in the neck ring, said plurality of faces ranging from five to nine in number.

16. The method of manufacture of claim 1 wherein a plurality of bottles are oriented in accordance with a predetermined configuration.

* * * * *